US010161145B2

(12) United States Patent
Lazaro Florensa

(10) Patent No.: US 10,161,145 B2
(45) Date of Patent: Dec. 25, 2018

(54) DEVICES FOR LEVELLING COVERING PARTS

(71) Applicant: GERMANS BOADA, S.A., Barcelona (ES)

(72) Inventor: Raul Lazaro Florensa, Barcelona (ES)

(73) Assignee: GERMANS BOADA, S.A., Barcelona (ES)

( * ) Notice: Subject to any disclaimer, the term of this patent is extended or adjusted under 35 U.S.C. 154(b) by 0 days.

(21) Appl. No.: 15/550,807

(22) PCT Filed: Dec. 15, 2015

(86) PCT No.: PCT/ES2015/070903

§ 371 (c)(1),
(2) Date: Aug. 14, 2017

(87) PCT Pub. No.: WO2016/135354

PCT Pub. Date: Sep. 1, 2016

(65) Prior Publication Data

US 2018/0030742 A1 Feb. 1, 2018

(30) Foreign Application Priority Data

Feb. 26, 2015 (ES) ..... 201530251

(51) Int. Cl.
*E04F 21/22* (2006.01)
*E04F 21/20* (2006.01)
*E04F 15/02* (2006.01)

(52) U.S. Cl.
CPC ..... *E04F 21/20* (2013.01); *E04F 15/02* (2013.01); *E04F 21/22* (2013.01)

(58) Field of Classification Search
CPC . E04F 21/0092; E04F 21/22; E04F 15/02022; E04F 21/1877
See application file for complete search history.

(56) References Cited

U.S. PATENT DOCUMENTS

| | | | | |
|---|---|---|---|---|
| 9,267,297 | B2 * | 2/2016 | Zinssler | E04F 13/0803 |
| 9,470,002 | B2 * | 10/2016 | Irvine | E04F 21/0092 |
| 9,657,485 | B2 * | 5/2017 | Meyers | E04F 21/1877 |
| 2004/0034375 | A1 * | 2/2004 | Ruiz | A61B 17/688 606/151 |

(Continued)

FOREIGN PATENT DOCUMENTS

| | | |
|---|---|---|
| BR | PI1001341 | 6/2011 |
| WO | 2014022889 | 2/2014 |

*Primary Examiner* — Brian E Glessner
*Assistant Examiner* — Daniel J Kenny
(74) *Attorney, Agent, or Firm* — Hodgson Russ LLP

(57) ABSTRACT

The invention relates to a levelling device comprising a first substantially flat body (1), provided with an appendage (11), in the top part, which has, on a first end, close to the first body (1), a first fracture zone (12) for the separation thereof from the first body (1) and, on a second end, at a distance from the first body (1), a hook (13) for attaching an actuating tool and a second fracture zone (15) with a lower fracture resistance than that of the first fracture zone (12); and a second, upper body (2) containing a passage (21) for mounting said body on the appendage (11) such that it can move into an operative position in which it presses the covering parts (P) against the first body (1).

1 Claim, 2 Drawing Sheets

(56) References Cited

U.S. PATENT DOCUMENTS

| | | | | |
|---|---|---|---|---|
| 2010/0263304 | A1* | 10/2010 | Torrents I Comas | ..... E04F 21/0092 52/126.5 |
| 2010/0287868 | A1 | 11/2010 | Kufner et al. | |
| 2014/0325935 | A1 | 11/2014 | Hoffman et al. | |

* cited by examiner

DEVICES FOR LEVELLING COVERING PARTS

OBJECT OF THE INVENTION

The object of the present invention are improvements in devices for levelling covering parts, applicable during the installation of said parts on a surface; said improvements consisting of the incorporation of a fracture zone on the levelling device which ensures predetermined pushing on the ceramic tiles suitable for ensuring the levelling thereof.

STATE OF THE ART

In the utility model application U 200930036 of the same applicant, a levelling device to place correctly aligned and leveled covering parts such as tiles or ceramic parts is described.

The device in question comprises a first substantially flat body to be placed under the covering parts, said first body being provided with an appendage that has a first end, joined to the first body, a first fracture zone for the separation thereof from the first body once it is used; and on a second end, at a distance from the first body, a hook, preferably a hole or a recess, for gripping an actuating tool. The levelling device comprises a second body with a passage for mounting said body on the appendage of the first body, such that it can move into an operative position in which it presses the covering parts against the first body, carrying out the alignment thereof.

As is common in this type of levelling device, the appendage of the first body and the passage of the second body have complementary coupling means, like a ratchet, that allows the second body to only move forward towards the first body, preventing its subsequent removal.

Once the covering parts are definitively placed and fastened to a surface, for example, by means of adhesive cement, silicone or another similar product, one only needs to fracture the appendage until the fracture resistance of the first fracture zone is overcome, such that the appendage is separated from the first body, together with the second body mounted on said appendage.

The cited prior art has some drawbacks in the case that the operator applies excessive force when pushing the second body along the appendage of the first body, since in this case, the appendage fractures in the fracture zone, leaving the device unused and useless.

On the other hand, if the operator does not push hard enough, the second body does not adequately press the covering parts against the first body of the device, leaving the covering parts unaligned or uneven.

Therefore, this device requires the operator to apply a controlled force that is enough to correctly position the ceramic parts but does not break the appendage and cause it to separate from the first body.

It is also worth mentioning that during the placement of the ceramic parts, the operators usually place the first body of the device and mount the second body on the appendage of the first body, without pushing them together, and then the different installed devices are subsequently pushed together.

This work operation involves the risk that some of the installed devices are left without being pushed since one cannot see whether each one of them has been pushed.

The applicant of the invention is unaware of the existence of prior art which makes it possible to satisfactorily solve the problem posed.

DESCRIPTION OF THE INVENTION

To solve the aforementioned problems, improvements that establish predetermined pushing of the levelling device on the ceramic parts, ensuring that they are perfectly aligned and leveled, and that visually determine whether the levelling device has been correctly pushed, thus preventing the unintentional fracture of the appendage on the end close to the first body during said pushing, have been introduced with the characteristics included in the precharacterizing part of the first claim into the aforementioned levelling devices of covering parts.

For that reason, the improvements provided in the invention consist of providing the appendage of the first body, on the second end thereof, with a second fracture zone with a lower fraction resistance than that of the first fracture zone close to the first body.

Said second fracture zone is arranged on the appendage such that upon actuating the levelling device, it fractures the appendage with the suitable tool and when the first body and second body exert a determined pressure on the ceramic parts to be applied, the appendage is fractured in the second fracture zone, which is arranged above the second body and, as a result, in a visible position.

This second fracture zone therefore makes it possible to ensure the application of a predetermined pressure on the ceramic parts and see whether the levelling devices used have been correctly pushed.

Once the ceramic parts are definitively fastened to a surface, one will only need to push the appendage again, in this case, with a greater force to achieve a fracture in the first fracture zone close to the first body and, as a result, the separation thereof together with the second body mounted on the appendage.

DESCRIPTION OF THE FIGURES

As a complement to the description provided herein, and for the purpose of helping to make the characteristics of the invention more readily understandable, the present specification is accompanied by a set of drawings, which, by way of illustration and not limitation, represent the following.

PREFERRED EMBODIMENT OF THE INVENTION

As can be seen in the figure, the levelling device of covering parts with the improvements object of the invention comprises a first body (1) provided with an appendage (11), in the top part, which has a first fracture zone (12) on a first end and an actuation hole on a second end by means of a tool (not shown).

Figure 1:
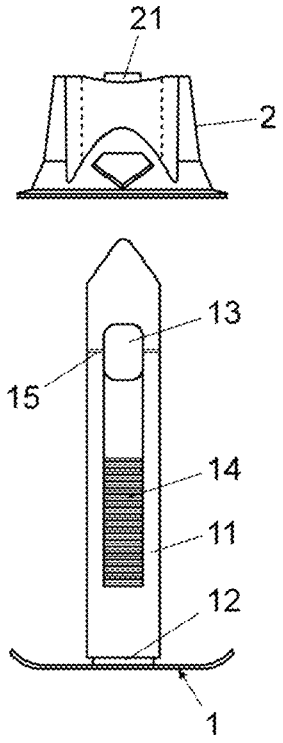
FIG. 1 shows a front elevation view of a levelling device of covering parts with the improvements of the invention.
Figure 2:
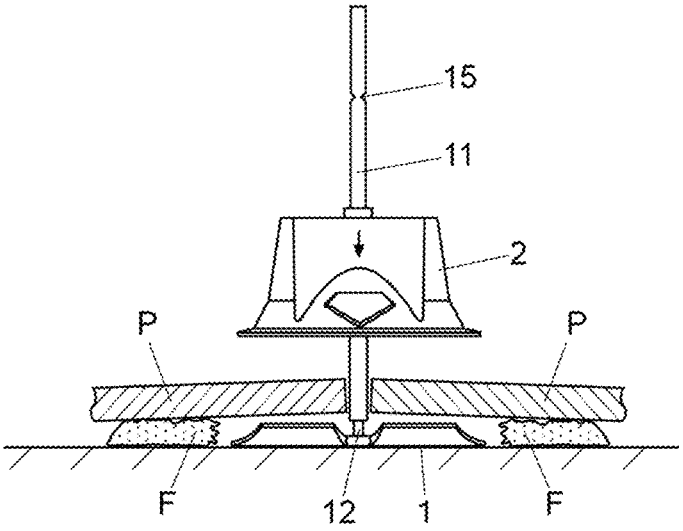
FIG. 2 shows a profile view of the levelling device of the previous figure in a position of use, before establishing pushing of the second body of the device against the ceramic parts to be installed.

The device further comprises a second body (2) containing a passage (21) for mounting said body on the appendage (11) towards the first body (1) as shown in FIG. 2.

As is common in this type of levelling device, the appendage (11) and the passage (21) incorporate complementary fastening means, like a ratchet, in this case made up of toothing (14) on the appendage (11) and restraint pins (not shown) housed in the passage (21) of the second body, which allow the second body (2) to move along the appendage (11) only towards the first body (1).

In FIG. 2, the first body (1) arranged under the covering parts to be fastened on a surface by means of a fastening product (F) and the second body (2) mounted on the appendage (11).

Figure 3:
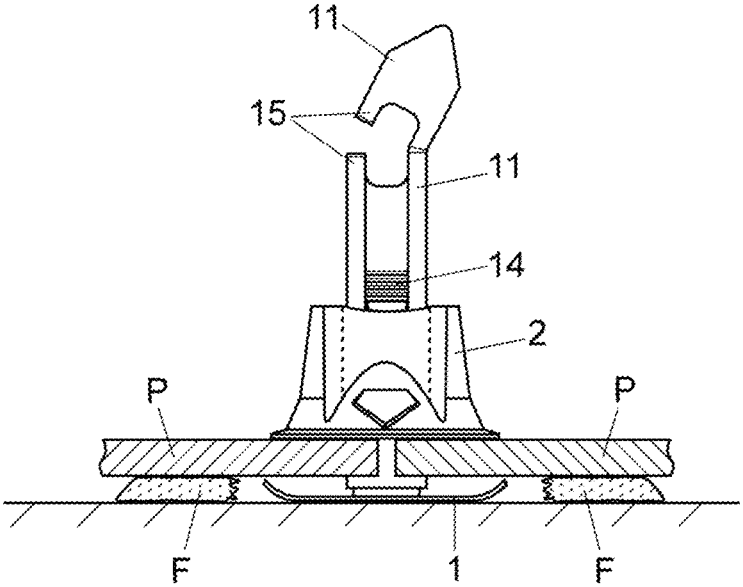
FIG. 3 shows an elevation view of the device of the previous figures with the improvements of the invention once pushing of the device and the fracture of the appendage in the second fracture zone are established.

By applying an increasing force on the hole (13) of the appendage and a decreasing force on the second body (2) by means of a suitable tool (not shown), the covering parts (P) are pushed by the second body (2) against the first body (1), as shown in FIG. 3, such that said parts are correctly leveled. Upon reaching a predetermined pressure, the appendage (11) is fractured in the second fracture zone (15), leaving visible proof that the device was correctly pushed.

Figure 4:
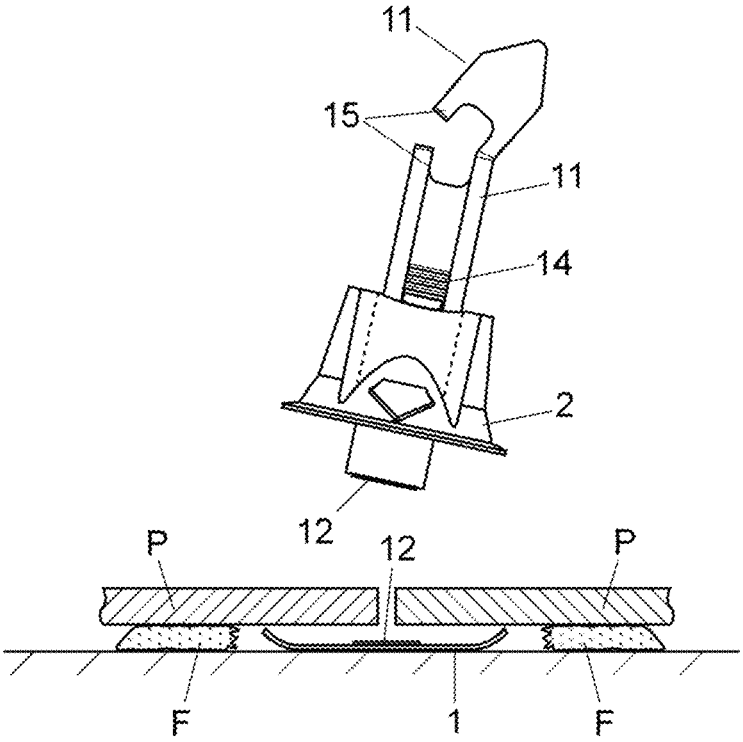
FIG. 4 shows a view of the device once the covering parts are fastened to a surface and the appendage is separated, along with the second body of the device, by means of fracturing said appendage in the first fracture zone.

Finally, once the covering parts are fastened to the surface in question, the appendage (11) is fractured until it fractures in the first fracture zone (12), separating itself from the first body (1), together with the second body (2), as shown in FIG. 4.

Having sufficiently described the nature of the invention, in addition to a preferred exemplary embodiment, it is hereby stated for the relevant purposes that the materials, shape, size and layout of the described elements may be modified, provided that it does not imply altering the essential characteristics of the invention claimed below.

The invention claimed is:

1. A levelling device for use in installing tiles, said device comprising:

a first substantially flat body (1), configured to be placed under the tiles to be installed, provided with an appendage (11) in a top part of the first substantially flat body (1), said appendage (11) having, on a first end close to the first substantially flat body (1), a first fracture zone (12) for the separation thereof from the first substantially flat body (1) and on a second end, at a distance from the first substantially flat body (1), a hole (13) for gripping an actuating tool, said hole (13) defining two lateral jambs in the appendage (11); and a second upper body (2) containing a passage (21) for mounting said first substantially flat body (1) on the appendage (11) such that the second upper body (2) is movable into an operative position in which the second upper body (2) presses the covering parts (P) against the first body (1), carrying out an alignment thereof by the actuating tool applying an increasing force on the hole (13) and a decreasing force on the second body (2);

wherein the appendage (11) comprises on the lateral jambs placed on the second end thereof, a second fracture zone (15) with a lower fracture resistance than that of the first fracture zone (12), such that upon reaching a predetermined pressure the appendage (11) is fractured in the second fracture zone (15), opening the hole (13) where the actuation tool is gripped and leaving visible proof that the device was correctly pushed.

* * * * *